United States Patent [19]

Durenec

[11] 4,433,550

[45] Feb. 28, 1984

[54] FREE PISTON DISPLACER CONTROL MEANS

[75] Inventor: Peter Durenec, Annandale, Va.

[73] Assignee: The United States of America as represented by the Secretary of the Army, Washington, D.C.

[21] Appl. No.: 372,787

[22] Filed: Apr. 28, 1982

[51] Int. Cl.[3] ..... F25B 9/00

[52] U.S. Cl. ..... 62/6; 60/520

[58] Field of Search ..... 60/517, 518, 520, 522; 62/6

[56] References Cited

U.S. PATENT DOCUMENTS

| | | | |
|---|---|---|---|
| 3,698,182 | 10/1972 | Knoos | 62/6 |
| 3,921,400 | 11/1975 | Pitcher | 62/6 |
| 3,971,230 | 7/1976 | Fletcher | 62/6 |
| 4,060,996 | 12/1977 | Hanson | 62/6 |

FOREIGN PATENT DOCUMENTS

| | | | |
|---|---|---|---|
| 605888 | 6/1960 | Italy | 62/6 |
| 686239 | 1/1953 | United Kingdom | 62/6 |
| 901761 | 5/1982 | U.S.S.R. | 62/6 |

*Primary Examiner*—Ronald C. Capossela

*Attorney, Agent, or Firm*—Robert P. Gibson; Milton W. Lee; Max L. Harwell

[57] ABSTRACT

A free piston displacer control means based on an offset axis mass attached to a crankshaft flywheel in which the rotating crankshaft reciprocates the piston displacer by driving the piston during the momentum of the stroke and by static braking at the end of each stroke at the period of maximum pressure exchange across the cooler frictional seal.

5 Claims, 3 Drawing Figures

FREE PISTON DISPLACER CONTROL MEANS

The invention described herein may be manufactured, used, and licensed by the U.S. Government for governmental purposes without the payment of any royalties thereon.

BACKGROUND OF THE INVENTION

1. Field of the Invention

The invention is in the field of free piston displacer movement by a crankshaft driving means having an offset mass flywheel operably connected to a directional flow control valve and to the displacer piston to respectively control the working fluid pressure waves to the cooler and to maintain a natural frequency of free piston displacer reciprocation.

2. Description of the Prior Art

A free displacer of a split cycle cryogenic cooler usually follows the sinusoidal waveforms of the working fluid pressure applied to the cold end in which the pneumatic volume does little to alter the sinusoidal waveforms. Even though magnetic means have been used to alter these sinusoidal waves into a more square type displacer waveform, i.e. provides dwell time at the extreme ends of displacer movement, the magnetic fields in the metal parts causes undesirable electronic noise. The present invention is comprised of a mechanical means for alternately driving and braking the piston displacer to produce flat top dead center and flat bottom dead center displacer waveforms.

SUMMARY OF THE INVENTION

The invention is a free piston displacer waveform control means, preferably in a split cycle cooler, in which a regenerator-displacer in the cold end of the cooler housing has a pneumatic piston rigidly attached thereto that extends through a passageway in the housing into an ambient temperature end. A friction seal between the piston and the housing passageway forms an effective frictional seal between the working fluid volume at the cold end and the pneumatic volume at the ambient end. A free piston displacer drive means is operably connected to a directional flow control valve for controlling pressure waves in the working fluid applied to the cooler and is mechanically attached to the piston for providing energy restoration to the free piston displacer during operation of the cooler. Operation of the free piston displacer is initiated by action of the compressor producing alternating pressure waves through the directional flow control valve and feed line means to the cooler to start reciprocal movement of the pneumatic piston and regenerator-displacer within the cooler housing. The free piston displacer drive means, other than driving the directional flow control valve, is comprised of a rotary crankshaft in the pneumatic volume that is rotationally-to-translationally connected to the pneumatic piston and has at least one energy restoring means thereon, preferably a flywheel having a mass of material thereon, to counteract motion of the reciprocating piston at both extreme ends of movement when the pressure differential across the effective frictional seal are the greatest. The pneumatic piston is thus slowed down or stopped at the end of each stroke to provide flat top and bottom dead center displacer waveforms.

DETAILED DESCRIPTION OF THE PREFERRED EMBODIMENT

Figure 1:
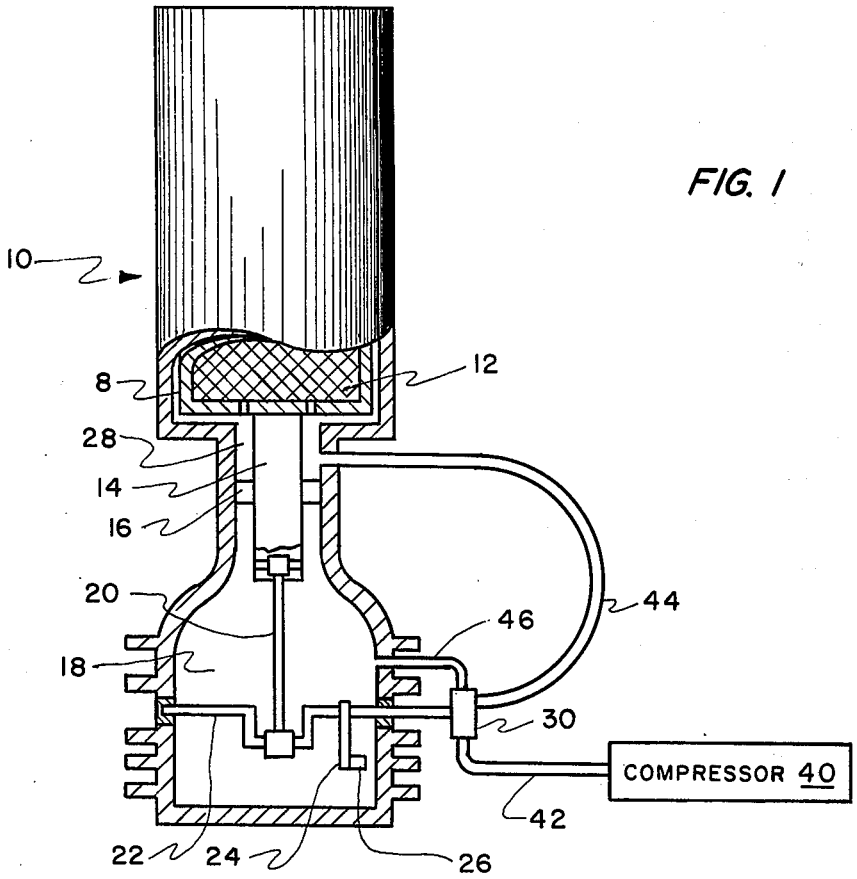
FIG. 1 illustrates a partial cut-away view of the present invention.

Refer to FIG. 1 where a cooler 10 is shown comprised of a cold end in which the regenerator-displacer 8 with matrix 12 therein is located in the working fluid volume 28 and an ambient temperature end in which the free piston displacer drive means is located in a pneumatic volume 18. A pneumatic piston 14 is rigidly attached to the displacer 8 and extends through a passageway of the cooler housing supported by a frictional seal 16 that forms an effective frictional seal between the working fluid volume 28 and the pneumatic volume 18. Piston 14 is connected to a crankshaft 22 by flexible connected wristpin and crankpin. The offaxis crankpin connection on the crankshaft 22 is 90° away from a lop-sided weighted mass, herein shown on a flywheel 24 as energy restoring means 26.

The crankshaft 22 may extend out the wall of the cooler housing to a directional flow control valve 30 which is connected to feed line means, comprised of an input compressor feed line 42 which has reciprocating pressure waves, usually sinusoidal, of working fluid therein and a first output feed line, or working fluid volume feed line 44, and a second output feed line, or pneumatic volume feed line 46. First and second output feed lines are preferably 180° out of phase to provide maximum differential pressures across seal 16 to overcome the weighted mass 26 at the ends of each stroke. It should be noted that even though 24 and 26 are shown inside volume 18 and valve 30 is shown outside the cooler housing, both may be inside or both outside or any combination thereof.

Figure 2A:
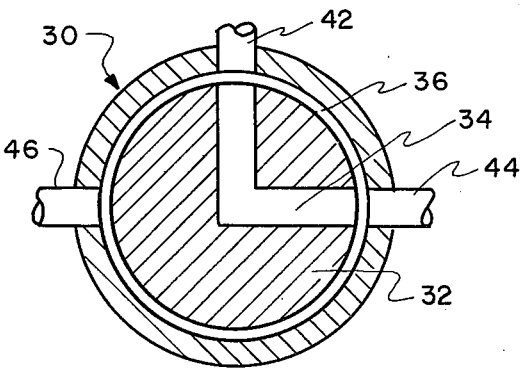
FIGS. 2A and 2B show sectional views at two rotary positions of the directional flow control valve employed in the invention.
Figure 2B:
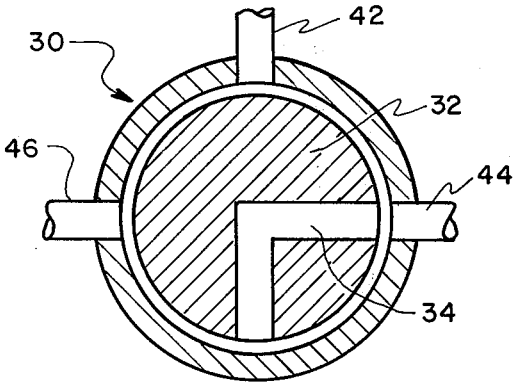

The free piston displacer is originally started by initial operation of the remote compressor 40, i.e. by fluidic motor operation. Refer now to FIGS. 2A and 2B which may be used to better explain the operation of the present free piston displacer movement control means. The directional flow control valve 30 will always start in the cooling cycle versus the heating cycle of operation. Even though the rotatable pool 32 is rigidly connected to the end of the crankshaft 22, the initiation of operation by the fluidic motor is comprised of the sinusoidal input pressure waves in feed line 42 being applied by compressor 40. Spool 32 will begin to rotate by the reciprocating pressures applied to the working fluid in cavity 36, between spool 32 and the housing of valve 30, and in the flow control passageways 34, which are shown as a right angled passageway but may be of different shape commensurate with the spool 32 shape and the selected number of feed line openings. The clearance of cavity 36 may be about 0.001 inch and the dimension of the passageway 34 may be about the same as for each of the feed lines 42, 44, and 46. When operation starts and the spool 32 begins to turn the crankshaft 22 also begins to rotate, causing the free piston displacer to reciprocate within the cooler housing. The output pressure waves from valve 30 will initially have their tops and bottoms flattened slightly, and with constant operation the top and bottom dead centers will become flat.

The weighted mass 26 on the flywheel 24 is out of synchronization with the flattened sinusoidal waves, i.e. the mass 26 is 90° out of phase with the reciprocating pressure waves so at the time the weighted mass is braking the differential pressure across seal 16 from the sinusoidal wave is driving piston 14 back again to overcome the braking. Thus, the restoring energy force from 26 and the opposing force from the working fluid sinusoidal pressure wave delay movement of the free piston displacer at the ends of each stroke and cooperate during each stroke until braking and driving forces again counteract with other. The kinetic energy equations, $$E_R = \tfrac{1}{2}MV^2 \qquad (1)$$

is not required to store work in the flywheel 24 but is required to take work out. That is, flywheel 24 and mass 26 are used as braking for the motion of the reciprocating piston displacer at both ends of the stroke. The amount of delay is governed by the total weight of the flywheel and mass, the radius of curvature, i.e. distance of offset, of the crankshaft, and the crankpin velocity. The weight of mass 26 is not critical since the pressure waves of the working fluid will drive the crankshaft anyhow. The split cycle cooler employed in this invention may typically operate at 25 Hertz. For a typical ¼ watt split cycle cooler, the radius of curvature may be about ¼ inch. It should be noted that the frequency of operation of the free piston displacer assumes a natural frequency with no stroke losses wherein impact at each end of the stroke are eliminated.

While only one preferred embodiment has been described in detail it is to be understood that other variations may be made while remaining within the split and scope of the invention which is limited only by the following claims.

I claim:

1. A free piston displaces control means comprising: a split cycle cooler enclosed in a housing having a regenerator-displacer in a cold end working fluid volume with a pneumatic piston attached to the displacer and extending through a passageway into an ambient end pneumatic volume of said housing wherein a friction seal between said pneumatic piston and said passageway forms an effective frictional seal between said working fluid volume and said pneumatic volume in which alternating pressure waves of working fluid are applied to said split cycle cooler through feed line means from a remote compressor to cause piston displacer reciprocal movement within said housing; and free piston displacer drive means comprised of a rotary crankshaft connected to said penumatic piston and with at least one energy restoring means thereon comprised of a flywheel having a mass of material thereon used as a braking means to counteract the motion of the reciprocating pneumatic piston at the top dead center and the bottom dead center of the strokes to selectively reciprocate said free piston displacer and wherein said rotary crankshaft drives a directional flow control valve for regulating the pressure waves of said working fluid in said feed line means wherein the combined regulated alternating pressure waves and said energy restoring means provide flat top dead center and flat bottom dead center displacer waveforms for better cooler efficiency.

2. A means as set forth in claim 1 wherein said rotary crankshaft is connected to said pneumatic piston by a displacer connecting rod from a crankpin on said crankshaft that is 90° from said flywheel with said mass of material thereon and wherein said directional flow control valve applies pressure waves in the working fluid across said effective frictional seal to overcome the braking means at the top and bottom dead centers of the strokes and restore momentum to said crankshaft.

3. A means as set forth in claim 2 wherein said feed line means is comprised of one input feed line from said remote compressor to said directional flow control valve and two output feed lines therefrom which are 180° out of phase in output of said alternating pressure waves of working fluid wherein a first output feed line is applied to said working fluid volume and a second output feed line is applied to said pneumatic volume wherein said alternating pressure waves in said first and second output feed lines are 180° out of phase across said effective frictional seal to overcome the dead mass weight at the maximum pressure differential.

4. A means as set forth in claim 3 wherein said directional flow control valve is a rotary spool control valve wherein a spool is rigidly connected to said crankshaft and is rotated within said rotary spool control valve to regulate the pressure waves of working fluid in said first and second output feed lines.

5. A means as set forth in claim 4 wherein a cavity between said spool and the housing of said directional flow control valve and flow control passageways within said spool direct said alternating pressure waves of working fluid to said first and second output feed lines.

* * * * *